US007980605B1

(12) United States Patent
Fuhrman

(10) Patent No.: US 7,980,605 B1
(45) Date of Patent: Jul. 19, 2011

(54) PORTABLE PUBLIC RESTROOM DOOR LOCK

(76) Inventor: Stefanie Fuhrman, Rockville, MD (US)

( * ) Notice: Subject to any disclaimer, the term of this patent is extended or adjusted under 35 U.S.C. 154(b) by 558 days.

(21) Appl. No.: 12/082,829

(22) Filed: Apr. 16, 2008

Related U.S. Application Data

(60) Provisional application No. 60/932,038, filed on May 29, 2007.

(51) Int. Cl.
*E05C 19/18* (2006.01)
*B65D 45/30* (2006.01)

(52) U.S. Cl. .. 292/288; 292/258; 292/289; 292/DIG. 38

(58) Field of Classification Search ..... 292/253, 292/258, 288–298, 339, 343, DIG. 15, DIG. 38, 292/91; D8/402; 52/285.3, 489.1, 582.1, 52/712; 24/293–295, 297; 49/394
See application file for complete search history.

(56) References Cited

U.S. PATENT DOCUMENTS 278,863 A * 6/1883 Boucher ..... 292/298
750,692 A * 1/1904 Poenitz ..... 292/297
1,079,860 A * 11/1913 Hiehl ..... 292/289
1,589,095 A * 6/1926 Beaudin ..... 292/294
1,607,789 A * 11/1926 Baker ..... 292/290
1,959,096 A * 5/1934 Birger ..... 24/295
2,536,941 A * 1/1951 Jones ..... 292/288
3,345,706 A * 10/1967 Stokes ..... 403/397
3,864,789 A * 2/1975 Leitner ..... 24/293
4,471,980 A * 9/1984 Hickman ..... 292/19
5,241,727 A * 9/1993 Lee ..... 24/453
5,253,908 A * 10/1993 Leonard, III ..... 292/289
5,539,962 A * 7/1996 Lee ..... 24/453
5,542,723 A * 8/1996 Scharf ..... 292/289
5,879,101 A * 3/1999 Hagura ..... 403/326
5,984,386 A * 11/1999 Clemens ..... 292/288
6,283,512 B1 * 9/2001 Butterbaugh et al. ..... 292/87
6,364,589 B1 * 4/2002 Wenglinski ..... 411/508
6,386,604 B1 * 5/2002 Scanlon ..... 292/339

* cited by examiner

*Primary Examiner* — Carlos Lugo
*Assistant Examiner* — Alyson M Merlino
(74) *Attorney, Agent, or Firm* — Donald A. Kettlestrings

(57) ABSTRACT

A portable public restroom door lock for holding stall doors of restrooms closed when the locking system normally provided for the door is inoperative. The device comprises opposed metal or plastic elastic arm members that can be squeezed together and slidably positioned between the stall door and the stall wall and then released to engage the stall door and the stall wall to hold the stall door in closed relationship with the stall wall.

8 Claims, 4 Drawing Sheets

PORTABLE PUBLIC RESTROOM DOOR LOCK

CROSS-REFERENCE TO RELATED APPLICATIONS

This application claims the benefit of U.S. provisional application No. 60/932,038, filed May 29, 2007.

BACKGROUND OF THE INVENTION

This invention relates to a portable door lock and more particularly to a portable public restroom door lock for holding stall doors of restrooms closed when the locking system provided is inoperative.

It is not uncommon for public restrooms to be poorly maintained and to find restroom stall door locks to be inoperative. This renders the restroom stall difficult and uncomfortable to use because the door will not remain in a closed position.

It is, therefore, an object of the present invention to provide a portable public restroom door lock.

Another object is to provide such a lock which is small and compact in size and which can conveniently be carried in a purse or on the person of a user.

A further object of the invention is the provision of such a lock which can be quickly and easily utilized to lock a public restroom door in a closed position when the restroom door lock is inoperative.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

BRIEF SUMMARY OF THE INVENTION

To achieve these and other objects, the present invention provides a portable door lock for holding a hinged public restroom stall door in a closed position, the lock comprising: a first elastic arm member defining first and second ends; a second elastic arm member defining third and fourth ends; the first and third ends connected together at a location to form an acute angle with each other at the location and with the second and fourth ends normally spaced apart from each other; a third arm member connected to the second end and extending perpendicularly from the first arm member, a fourth arm member connected to the first arm member, located a first predetermined distance from the third arm member and extending perpendicularly from the first arm member; a fifth arm member connected to the fourth end and extending perpendicularly from the second arm member, and a sixth arm member connected to the second arm member, located a second predetermined distance from the fifth arm member and extending perpendicularly from the second arm member.

BRIEF DESCRIPTION OF THE SEVERAL VIEWS OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE INVENTION

Figure 1:
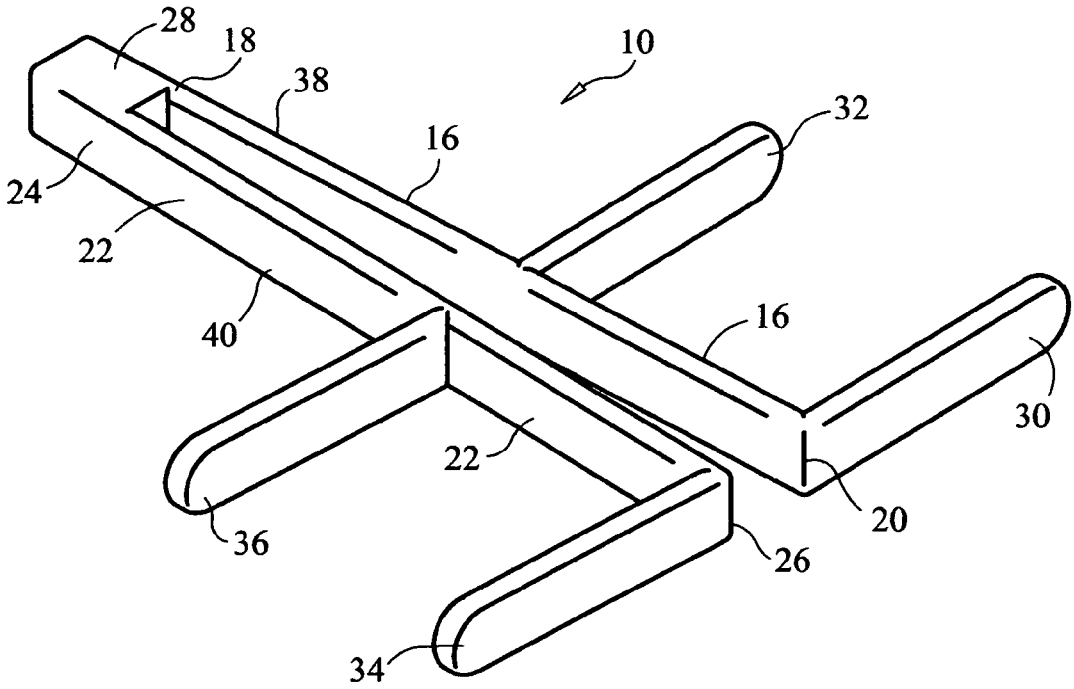
FIG. 1 is a perspective view showing the lock of this invention.

With reference now to the drawings, wherein like reference characters designate like or corresponding parts throughout the several views, there is shown a portable door lock 10 in accordance with this invention for holding a conventional hinged public restroom stall door 12 in a closed position with respect to a conventional public restroom stall wall 14.

In accordance with the invention, lock 10 includes a first elongated, elastic arm member 16 defining first and second ends 18, 20, respectively.

Lock 10 further includes a second elongated, elastic arm member 22 defining third and fourth ends 24, 26, respectively.

First and third ends 18, 24 are conventionally connected together at location 28 to form an acute angle A with each other with second and fourth ends 20, 26 normally spaced apart from each other. (See FIG. 4.)

Further in accordance with the invention, a third arm member 30 is conventionally connected to second end 20 and extends outwardly and perpendicularly from first arm member 16.

A fourth arm member 32 is also conventionally connected to first arm member 16, and is located a first predetermined distance from third arm member 30. Fourth arm member 32 also extends perpendicularly and outwardly from first arm member 16.

A fifth arm member 34 is conventionally connected to fourth end 26 and extends perpendicularly and outwardly from second arm member 22.

A sixth arm member 36 is similarly conventionally connected to second arm member 22 and is located a second predetermined distance from fifth arm member 34. Sixth arm member 36 extends perpendicularly and outwardly from second arm member 22.

Further in accordance with the invention, the first and second predetermined distances are each greater than the thicknesses of conventional restroom stall doors 12 and conventional restroom stall walls 14, respectively.

First elongated arm member 16 defines a lengthwise dimension between second end 20 and location 28 equal to the lengthwise dimension of second arm member 22 between fourth end 26 and location 28. Arm members 16, 22 are elastic in directions substantially parallel with respect to arm members 30, 32 and arm members 34, 36, respectively, and perpendicular to their lengthwise dimensions for enabling a user of lock 10 to squeeze arm members 16, 22 together such that second and fourth ends 20, 26 are positioned in contacting, or nearly contacting, relationship with each other. (See FIG. 2.)

Arm members 16, 22 are further dimensioned for enabling them to be slidably positioned between a conventional public restroom door 12 and a conventional public restroom stall wall 14 when arm members 16, 22 are squeezed together by a user.

Lock 10 further includes first and second handle grip portions 38, 40, respectively, of arm members 16, 22, respectively, for enabling a user to comfortably grip lock 10. First handle grip portion 38 is located between fourth arm member 32 and location 28, and second handle grip portion 40 is located between sixth arm member 36 and location 28. All edges of handle grip portions 38, 40 and all other edges of lock 10 are preferably rounded for comfort of use and safety.

In operation and use, first and second arm members 16, 22 are squeezed together by the user grasping handle grip portions 38, 40 and exerting pressure on the handle grip portions using the user's thumb and forefinger. (See FIG. 2.) This results in arm members 16, 22 being brought together with ends 20, 26 positioned in contacting, or nearly contacting, relationship with each other.

Figure 2:
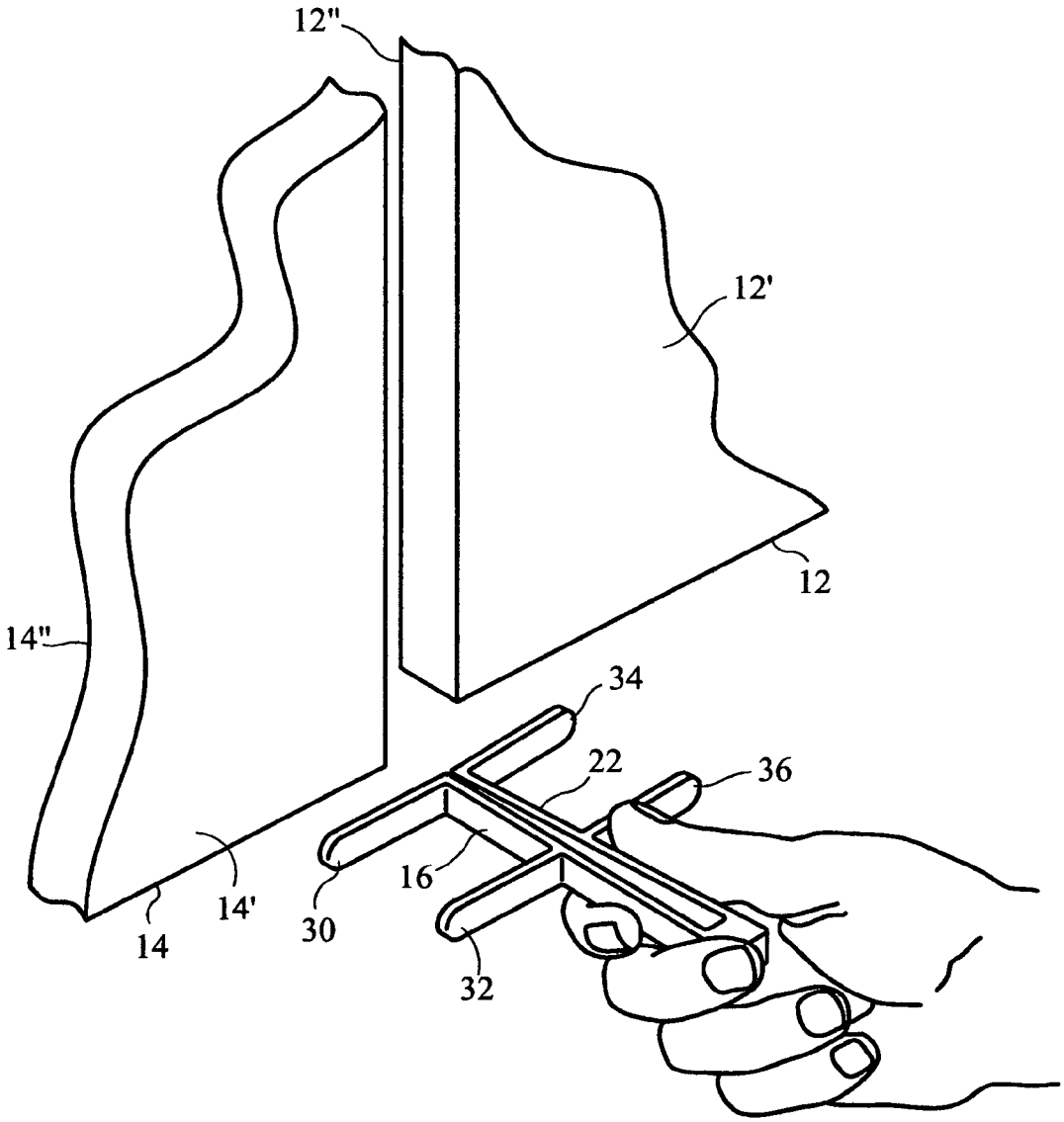
FIG. 2 is a fragmentary perspective view showing the lock in use.
Figure 4:
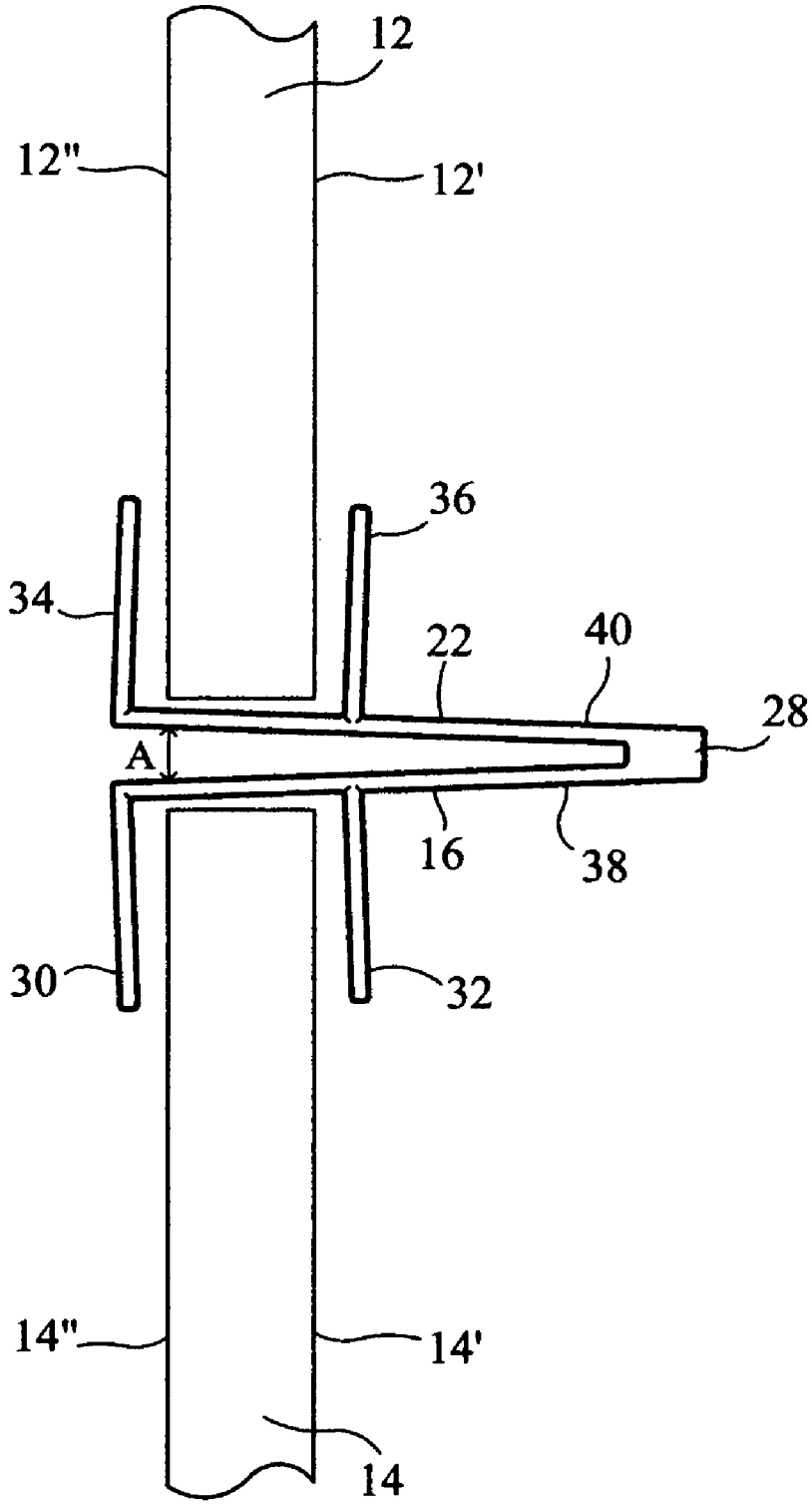
FIG. 4 is a fragmentary top plan view showing the lock in position between a restroom stall door and a restroom stall wall.

As shown in FIGS. 2 and 4 arm members 16, 22 are then positioned by the user to fit between stall door 12 and stall wall 14. Arm members 32, 30 are positioned to be located adjacent to rear and front surfaces 14', 14", respectively, of stall wall 14. Likewise, arm members 36, 34 are positioned to be adjacent to rear and front surfaces 12', 12", respectively, of stall door 12.

Figure 3:
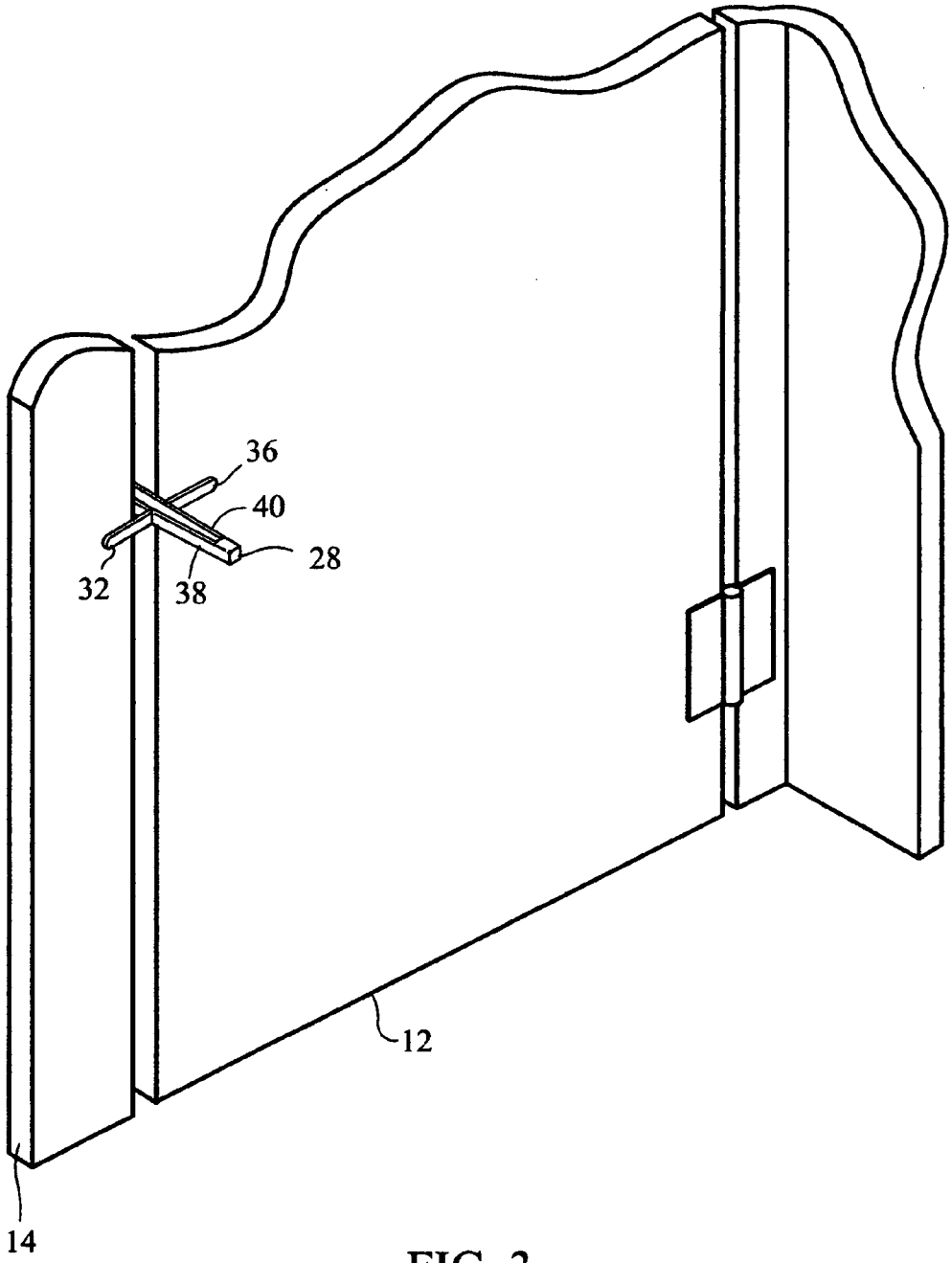
FIG. 3 is a fragmentary perspective view showing the lock in position between a restroom stall door and a restroom stall wall.

Lock 10 is then slid between stall door 12 and stall wall 14 until lock 10 is positioned in a location desired by the user. (See FIG. 3.) Handle grip portions 38, 40 are then released, and arm members 16, 22 spring outwardly so that arm members 16, 22 are pressed against wall 14 and against door 12, respectively. (See FIG. 4.)

Arm members 32, 30 may come to rest against rear surface 14' and front surface 14" of wall 14, respectively, to help maintain lock 10 in fixed position between door 12 and wall 14. Similarly, arm members 36, 34 may rest against rear surface 12' and front surface 12" of door 12, respectively, to help maintain lock 10 in position between door 12 and wall 14.

Lock 10 can be quickly and easily removed from its position between door 12 and wall 14 by the user squeezing handle grip portions 38, 40 together and by sliding lock 10 upwardly or downwardly along the gap between door 12 and wall 14 until lock 10 can be removed.

Lock 10 may preferably be made of sixteen-gauge steel, plastic or a combination of plastic and sixteen-gauge steel.

The invention in its broader aspects is not limited to the specific details shown and described, and departures may be made from such details without departing from the principles of the invention and without sacrificing its chief advantages.

What is claimed is:

1. A portable door lock (10) for holding a hinged public restroom stall door (12) in a closed position with respect to a restroom stall wall (14), said lock (10) comprising:

a first elongated elastic arm member (16) defining first (18) and second (20) ends;

a second elongated elastic arm member (22) defining third (24) and fourth (26) ends;

said first (18) and third (24) ends connected together at a location (28) with said second (20) and fourth (26) ends normally spaced apart from each other when said first and second arm members (16), (22) are not squeezed together;

a third arm member (30) connected adjacent to said second end (20) and extending substantially perpendicularly and outwardly from said first arm member (16);

a fourth arm member (32) connected to said first arm member (16) located a first predetermined distance from said third arm member (30) and outwardly extending substantially perpendicularly from said first arm member (16);

a fifth arm member (34) connected adjacent to said fourth end (26) and extending substantially perpendicularly and outwardly from said second arm member (22); and a sixth arm member (36) connected to said second arm member (22), located a second predetermined distance from said fifth arm member (34) and outwardly extending substantially perpendicularly from said second arm member (22), wherein said first and second predetermined distances are equal to each other wherein the first predetermined distance is adapted to receive the thickness of one of the restroom stall door and restroom stall wall and the second predetermined distance is adapted to receive the thickness of the other of the restroom stall door and restroom stall wall to lock the door in the closed position.

2. The lock (10) as in claim 1 wherein said first and second predetermined distances are each greater than the thickness of said restroom stall door (12) and said stall wall (14), respectively.

3. The lock (10) as in claim 2 wherein said first (16) and second (22) elongated arm members define lengthwise dimensions substantially equal to each other and wherein said first (16) and second (22) elongated arm members are elastic in directions substantially perpendicular to their said lengthwise dimensions and substantially parallel with respect to said third (30) and fourth (32) arm members and with respect to said fifth (34) and sixth (36) arm members, respectively.

4. The lock (10) as in claim 3 wherein said first (16) and second (22) elongated arm members are dimensioned for enabling them to be slidably positioned between said public restroom stall door (12) when closed and said public restroom stall wall (14) when said first (16) and second (22) arm members are squeezed together by a user with said second (20) and said fourth (26) ends positioned in substantially contacting relationship with each other.

5. The lock (10) as in claim 4 wherein said lock (10) is held in position between said door (12) and said wall (14) by said first (16), third (30) and fourth (32) arm members contacting said door (12) and by said second (22), fifth (34) and sixth (36) arm members contacting said wall (14) when said first (16) and second arm (22) members are released by the user after having positioned said first (16) and second (22) arm members between said door (12) and said wall (14).

6. The lock (10) as in claim 5 wherein said first (16) and second (22) arm members include first (38) and second (40) handle grip portions for enabling the user to comfortably grip said lock (10).

7. The lock (10) as in claim 6 wherein said first handle grip portion (38) is located between said fourth arm member (32) and said location (28) of said connection between said first (18) and said third (24) ends and wherein said second handle grip portion (40) is located between said sixth arm member (36) and said location (28) of said connection between said first (18) and said third (24) ends.

8. The lock (10) as in claim 7 wherein said first (16) and second (22) arm members form an acute angle with each other at said location (28) of said connection between said first (18) and said third (24) ends.

* * * * *